United States Patent [19]

Brand et al.

[11] 4,316,346

[45] Feb. 23, 1982

[54] SPUR TRACK ACCESSORY OPERATION

[76] Inventors: Derek A. Brand, 965 Camino Concordia, Camarillo, Calif. 93010; Derek R. Brand, 126 Ash Ave., Apartment 15, Carpinteria, Calif. 93013

[21] Appl. No.: 144,459

[22] Filed: Apr. 28, 1980

[51] Int. Cl.[3] ..... A63H 17/40; A63H 11/10; A63H 33/30; A63H 19/00

[52] U.S. Cl. ..... 46/212; 46/202; 46/40; 46/216

[58] Field of Search ..... 46/40, 202, 204, 212, 46/216, 261, 262

[56] References Cited

U.S. PATENT DOCUMENTS

| | | | |
|---|---|---|---|
| 1,212,683 | 1/1917 | Robinson | 104/1 |
| 1,275,754 | 8/1918 | Rockwood | 104/1 |
| 3,154,022 | 10/1964 | Lohr et al. | 104/1 |
| 3,562,950 | 2/1971 | Genin | 46/204 |
| 3,589,063 | 6/1971 | Genin | 46/202 |
| 4,091,562 | 5/1978 | Kimura | 46/216 |
| 4,100,696 | 7/1978 | Ogasawara | 46/216 |
| 4,128,964 | 12/1978 | Ogasawara | 46/40 |
| 4,222,195 | 9/1980 | Kurosawa et al. | 46/212 |

*Primary Examiner*—Gene Mancene
*Assistant Examiner*—Michael J. Foycik
*Attorney, Agent, or Firm*—Harry W. Brelsford

[57] ABSTRACT

A toy vehicle movable on a track operates an accessory with its wheels when it abuts a stop member. A manually operable remote control is used to then reverse the rotation of the wheels to remove the vehicle from the stop member.

7 Claims, 11 Drawing Figures

SPUR TRACK ACCESSORY OPERATION

This invention relates to motor driven toy vehicles which move on tracks and has particular reference to energizing accessory toys on spur tracks by the motor of the vehicle.

BACKGROUND OF THE INVENTION

To enhance the enjoyment of operating tracked vehicle toys such as model railroads, model highways, model ship canals, etc. accessory devices are operated at different points along the track. Toy persons that wave at the train, and power shovels that load trucks and cars are common examples of such accessories. To reduce the complexity of such track systems and to reduce cost, there has been a preference for powering such devices by the vehicle itself. This is done by mechanically stopping the powered vehicle at a selected point on the path so that the driven wheels of the vehicle stop on rollers that are driven by the wheels of the vehicle. These rollers in turn power the accessory, and for example, cause a toy merry-go-round to rotate. Heretofore these vehicle powered accessories have required a mechanical stop, for example, an upright post to be manually erected or withdrawn in order to stop the vehicle and then to allow it to proceed.

SUMMARY OF THE INVENTION

We have discovered that this stopping of the vehicle, operating the accessory, and then moving the vehicle can be accomplished by remote control, thereby eliminating any manual operation. Furthermore, we use conventionally available controls and equipment for achieving this result. The enjoyment of the operator is enhanced because of this absence of manual stops and manual releases.

The most popular tracked vehicles are operated by electric current supplied to the tracks and thereby supplied to the vehicle. Usually there is a control to reverse the direction of current flow and thereby reverse the vehicle. We make use of these remote electrical controls to operate our accessories. This is done by supplying the track with biased switches that permit traffic to proceed in one direction on the main track but which divert the vehicle to a spur track when the vehicle is operated in reverse. We then employ permanent stops at the end of the spur track to stop the vehicle over rollers which are rotated by the vehicle wheels and in turn operate an accessory. The vehicle is released from the accessory takeoff by again reversing the vehicle direction.

DESCRIPTION

Various objects, advantages and features of this invention will be apparent in the following description and claims considered together with the drawings forming an integral part of the specification in which:

Figure 1:
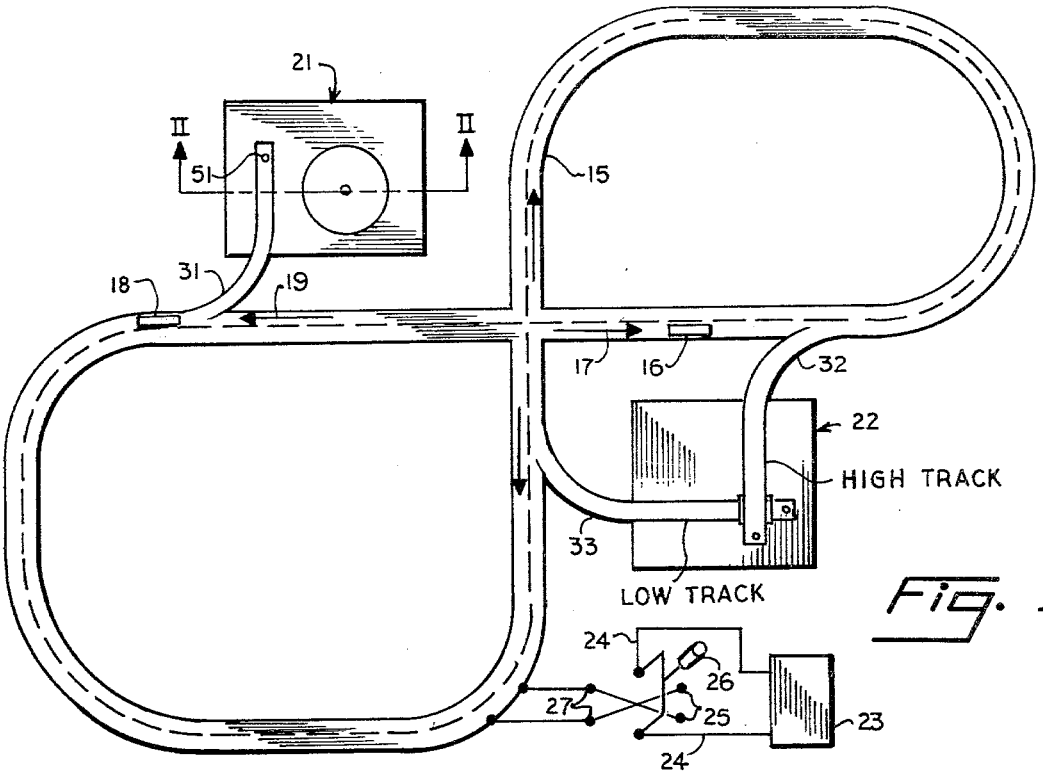
FIG. 1 is a plan view of a closed circuit having a single spur track in the upper left hand corner and double spur tracks in the lower right hand corner.
Figure 8:
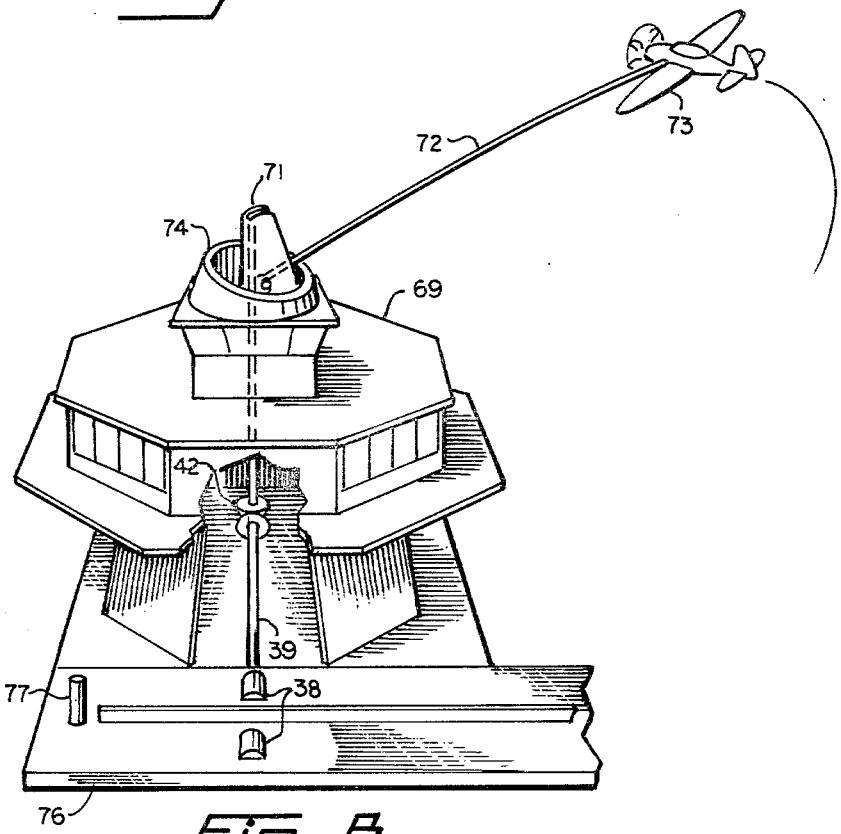
FIG. 8 is a three dimensional view of an accessory in the form of an airport having an airplane circling about on a rotating wand wherein the airplane is driven by a power takeoff mechanism.

Referring to FIG. 1 there is illustrated a closed path 15 for vehicles that can be run continuously, and any desired shape can be used although for illustrative purposes a figure 8 shape is employed. The pathway can be either a roadway, in which case the toy vehicles will be automobiles or trucks, or a railroad in which case the toy vehicles will be railroad cars or locomotives. There is illustrated a toy vehicle 16 which moves on the path 15 in the direction of the arrow 17 and there is illustrated a vehicle 18 which moves on the path 15 in the direction of the arrow 19. Shown in the upper left hand corner of FIG. 1 is an accessory assembly 21 wherein the accessory is driven in rotation by the wheels of the vehicle. This accessory 21 is connected to the closed path 15 by a spur track 31. Shown in the lower right hand part of FIG. 1 is an accessory 22 which is driven in part by the lateral or linear motion of the vehicles. This accessory 22 is connected to the main path 15 by spur tracks 32 and 33. Shown in the bottom center part of FIG. 1 is a power supply 23 having conductors 24 connected to a reversing switch 26 which is manually actuated to connect a pair of terminals 27 to the power supply to drive the vehicles 16 and 18 in a forward direction and which may be manually actuated to connect to the terminals 25 to drive the vehicles 16 and 18 in a reverse direction.

Figure 11:
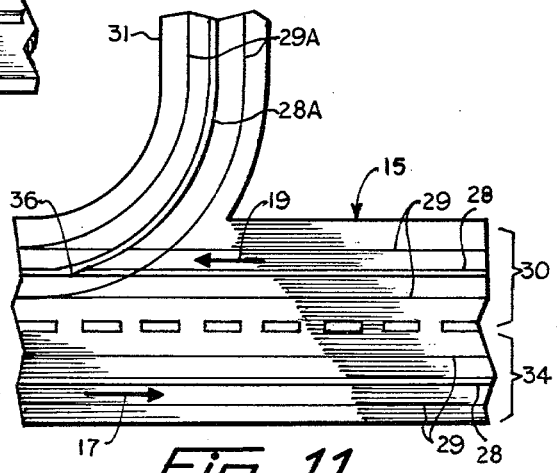
FIG. 11 is a plan view on an enlarged scale of a fragment of the roadway at the spur track in the upper left hand corner of FIG. 1.

Illustrated in FIG. 11 is a segment of the track 15 in the region of the accessory assembly 21. The roadway 15 has an upper half 30 and a lower half 34 each having a guide groove 28 down the center of each half. Traffic moves on the upper half 30 in the direction of the arrow 19 and traffic moves on the lower half 34 in the direction of the arrow 17. A pair of conductors 29 disposed one on each side of the guide grooves 28 energize the vehicles in a manner well known in the art. Branching from the upper half 30 of the roadway 15 is a spur track 31 which is concave to the left; it has a guide groove 28A and electrical conductors 29A on each side of the guide groove connected electrically to conductors 29. A flexible switching finger 36 is secured to the inside of the groove 28A and this switching finger 36 is flexible enough to be brushed aside or pushed aside by a guide pin which depends from a vehicle as the vehicle travels in the direction of the arrow 19. If, however, the vehicle is traveling in the reverse direction, approaching spur 31 from the left, then the guide pin will slide along this flexible finger 36 and will be guided up the spur path 31. The switching mechanism for the spurs 32 and 33 may operate in the same fashion, although manual or electrically operated switches could be used to obtain the same effect.

Figure 2:
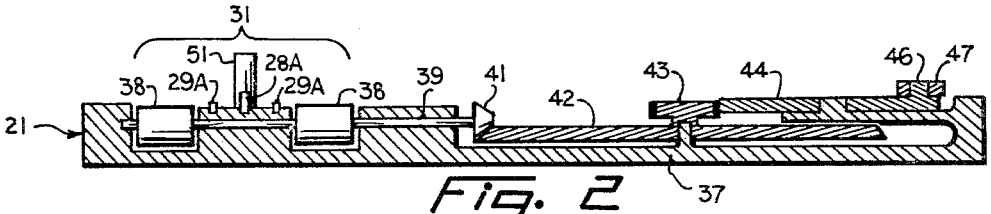
FIG. 2 is an elevation view on an enlarged scale and in full section of the accessory drive in the upper left hand corner of FIG. 1 taken along the line II—II of FIG. 1.
Figure 3:
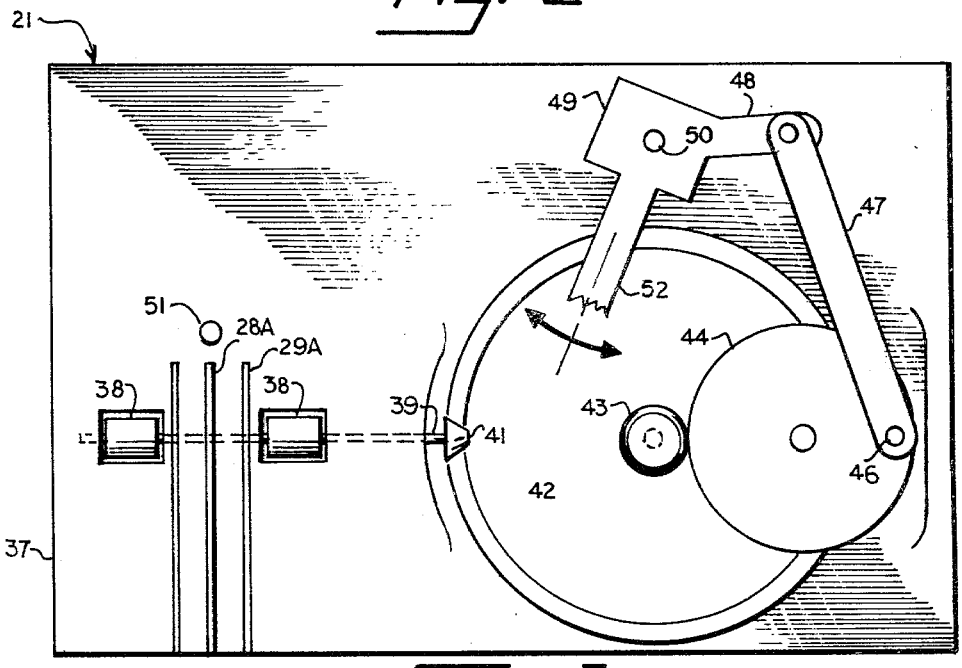
FIG. 3 is a plan view of the power takeoff and accessory drive mechanism of FIGS. 1 and 2.

Referring to FIGS. 1, 2 and 3 the accessory assembly 21 has a base 37 upon which the spur roadway 31 is mounted, and it will be noted that the spur roadway 31 includes the guide groove 28A and electrical conductors 29A. Mounted over the tread portions of the spur roadway 31 are a pair of rollers 38 mounted on a rotatable shaft 39 having a small bevel drive gear 41 secured to its inner end which in turn engages the bevel teeth of a large reduction gear 42; this gear in turn has a small spur gear 43 connected to it which in turn drives a crank gear 44 having a crank pin 46 upon which is mounted a connecting rod 47 connected pivotably to an arm 48 projecting from an oscillating base 49 which is pivoted at 50. Projecting from the oscillating base 49 is a crane arm 52.

The operation of the accessory assembly 21 of FIGS. 1, 2 and 3 is initiated by a vehicle 18 backing onto the spur roadway 31 until the vehicle strikes a permanent stop 51. This stop is so spaced with respect to the rollers 38 and the driving wheels on the particular powered vehicle that the driving wheels of the vehicle contact the rollers 38 and the continued application of power to these wheels causes them to rotate the rollers 38. This in turn drives the shaft 39, the bevel gear 41, the large reduction bevel gear 42, the spur gear 43 and the crank gear 44 so that the connecting rod 47 moves back and forth to oscillate the base 49 about its pivot 50. This in turn causes an oscillation of the crane arm 52.

Figure 4:
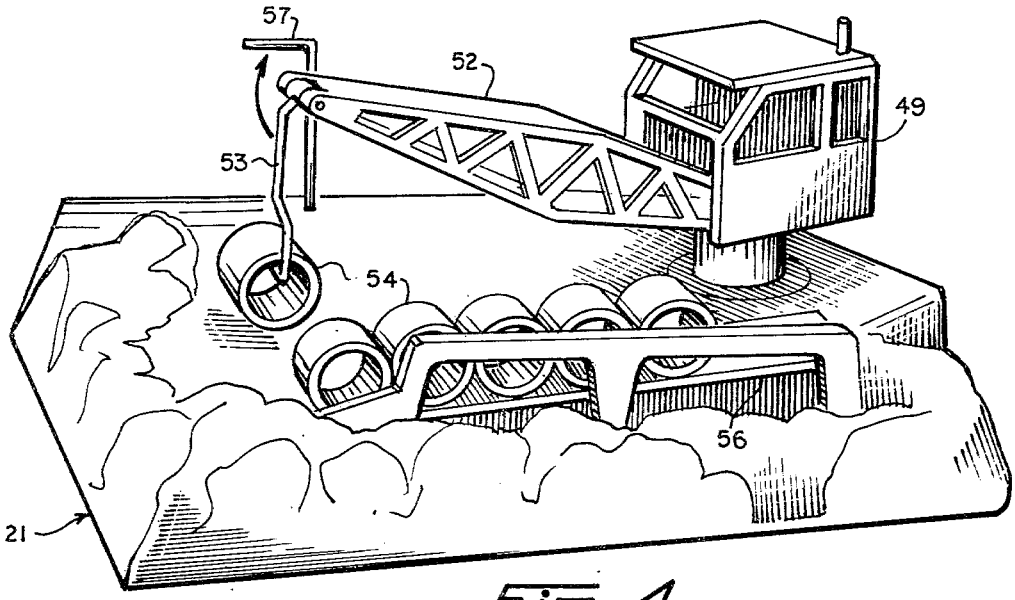
FIG. 4 is a three dimensional view of an accessory driven by the mechanism of FIGS. 1, 2 and 3 and this accessory is in the form of a crane which oscillates about its axis to pick up and dump objects such as pipes into a nearby truck or railroad car.
Figure 5:
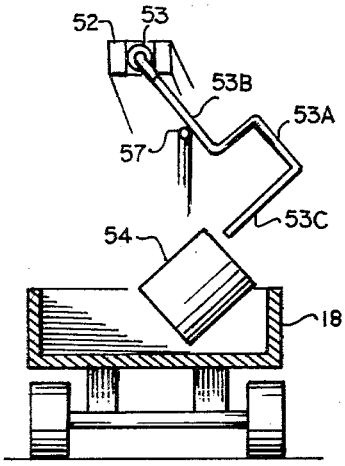
FIG. 5 is an elevation view of a truck partly in section and of the outer end of the crane of FIG. 4 showing it about to drop a pipe section into the truck.

Referring to FIGS. 4 and 5 there is illustrated the accessory assembly 21 as viewed from the right in FIG. 1. An accessory such as a crane cab in the form of an oscillating base 49 is provided with a crane arm 52 having a hook 53 pivotally attached to its outer end. The hook has a bight 53A and a stem 53B. The cab 49 will oscillate back and forth and the level of the hook 42 is such that when it oscillates toward the viewer in FIG. 4 the finger portion 53C of bight 53A contacts a round section of pipe 43, causing the hook 53 to slide over pipe 43 and it clears the pipe as crane arm 42 reaches its extreme of movement toward the viewer at which it reverses direction. The finger portion 53C then engages the pipe to move it off a pipe stand 56 as the crane oscillates away from the viewer in FIG. 4 to a waiting truck vehicle 18 shown in FIG. 5. A stationary stop 57 is provided that is slidingly contacted by the stem 53B to cause hook 53 to rotate counterclockwise as the crane arm 52 continues to move away from the viewer whereupon the pipe 43 slides off the hook 53 and into the truck 18.

Figure 6:
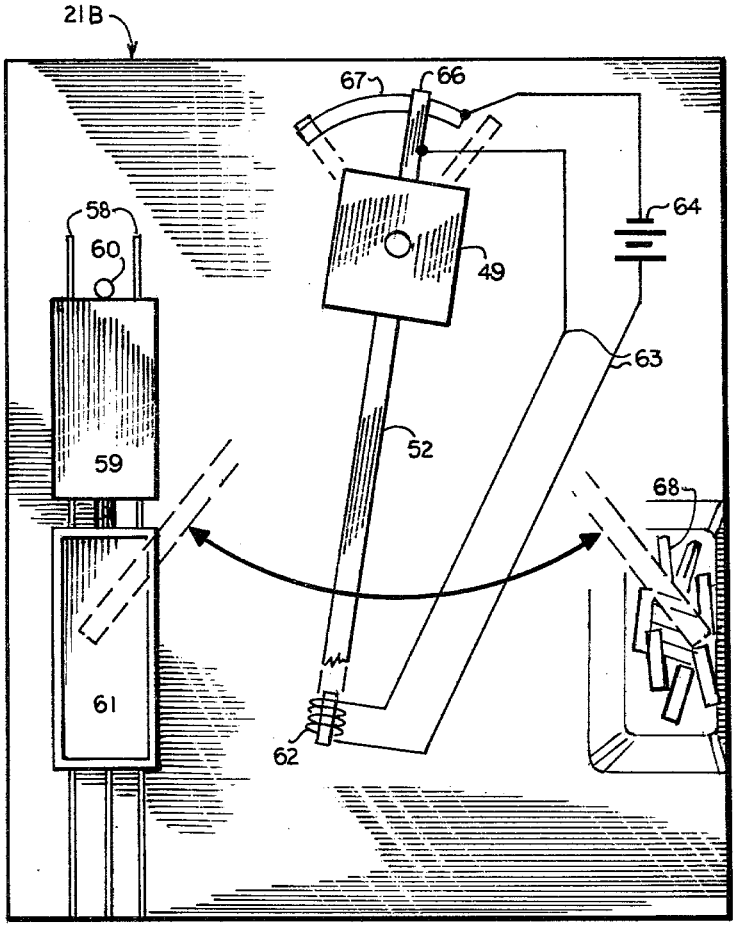
FIG. 6 is a schematic plan view of a crane similar to that of FIG. 4 but which is energized by an electromagnet to pick up scrap iron and to drop it into a toy railroad car.

The basic mechanism of FIGS. 1, 2 and 3 is used also to power an accessory in the form of a crane for moving scrap metal from a pile into a truck such as the truck shown in FIG. 5. This is shown in FIG. 6 in schematic diagram wherein an accessory assembly 21B has the same oscillating base 49 and instead of a roadway path onto the accessory there is a pair of railroad rails 58 upon which ride a railroad locomotive 59 connected to an open top railroad car 61; instead of a hook 53 as shown in FIG. 4 there is connected to the outer end of the crane arm 52 an electromagnet 62 energized by conductors 63 receiving electrical power from a source such as a battery 64. Projecting from the upper end of the oscillating base 49 is a switch finger 66 which rubs against an electrical contact 67 to which one of the conductors 63 is connected.

The operation of the device of FIG. 6 is as follows. The locomotive 59 is backed onto the tracks 58 and engages a stop 60 which causes the locomotive to stop over the rollers 38 of FIGS. 2 and 3 and it in turn causes the rollers 38 to rotate and these in turn causes the oscillation of the base 49 as described with respect to FIG. 3. The electromagnet will be energized at all times that the crane arm 52 is moving counterclockwise as viewed in FIG. 6. As the crane arm 52 reaches its extreme of movement in a counterclockwise direction the electromagnet 62 will be in the vicinity of a pile of scrap iron 68 and thereupon the scrap iron is secured by magnetism to the electromagnet 62. The electromagnet retains the scrap iron until crane arm 52 moves to its extreme clockwise movement in its oscillation whereupon the electromagnet will be over the top of the railroad car 61. At this point the switch finger 66 will ride off the end of the curved contact 67 and the circuit to the electromagnet 62 will be broken; the electromagnet is then deenergized and drops its scrap iron into the railroad car 61.

Referring to FIG. 8 there is illustrated a modified form of accessory in the nature of an airport building 69 which has a rotatable housing 71 at the top center thereof and from which projects a flexible wand 72 having an airplane 73 connected to its outer end. Positioned about the rotating member 71 is a beveled cylinder 74 which causes the wand 72 to move upwardly and downwardly during each rotation. The rotatable member 71 is driven by a vehicle on a spur track 76 and the vehicle stop at a stop 77 whereupon the drive wheels of the vehicle engage rollers 38 to rotate the shaft 39 which in turn causes rotation of the bevel reduction gear 42. In this case the rotatable member 71 may be connected directly to the center of the reduction gear 42.

Figure 9:
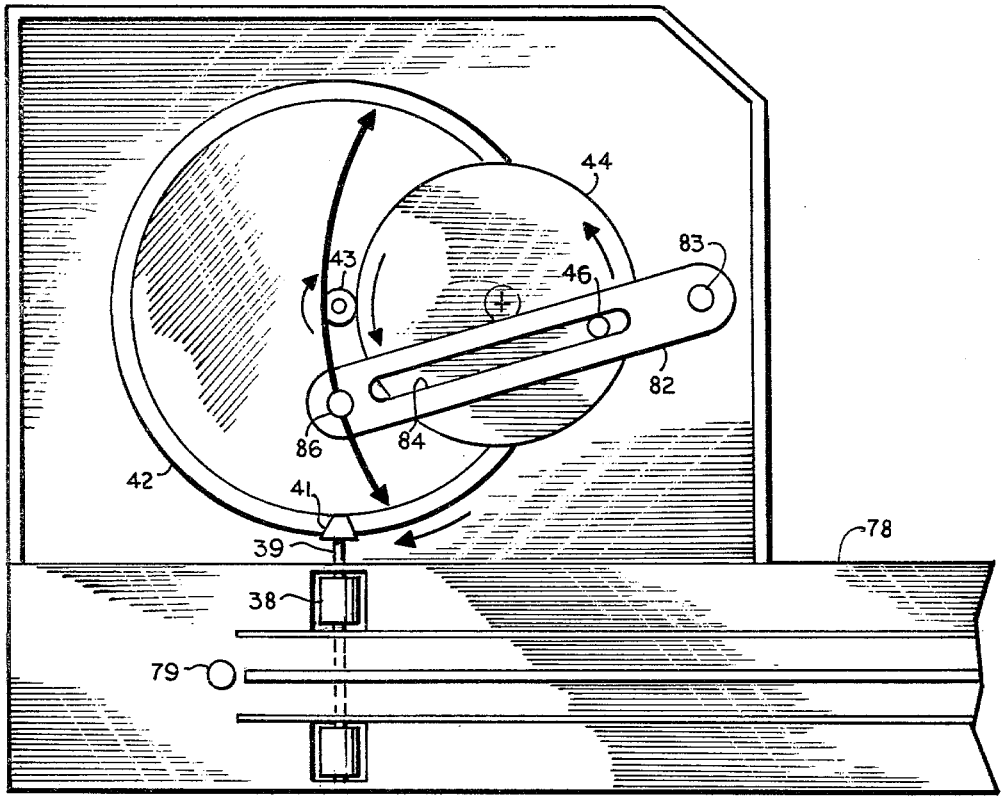
FIG. 9 is a plan view of a modified form of drive for an accessory wherein a lever arm oscillates through an angle to drive an accessory.
Figure 10:
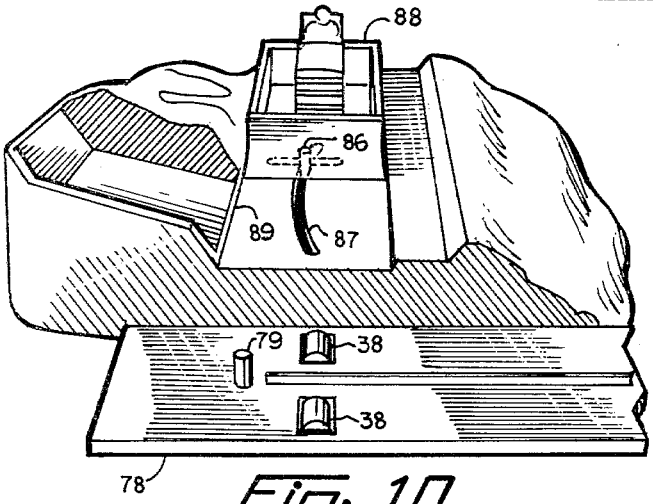
FIG. 10 is a plan view of a toy bulldozer driven by the accessory drive of FIG. 9.

Illustrated in FIGS. 9 and 10 is still another modification or variation of an accessory in the nature of a bulldozer pushing materials off an elevated platform into the open top of a vehicle, either a truck vehicle or a railroad vehicle. A track or roadway 78 has a stop 79 causing the vehicle wheels 81 to contact the rollers 38 and these in turn cause the shaft 39 to rotate, rotating the reduction gear 42, the spur gear 43 and the crank gear 44. Passing over the top of the crank gear 44 is an oscillating arm 82 pivoted at a pin 83 and this arm has longitudinal slot 84 in which the crank pin 46 is disposed. As the crank gear 44 rotates the arm 82 oscillates through a limited angle. Projecting upwardly from the left end of the arm 82 as seen in FIG. 9 is a pin 86 which passes up through a slot 87 shown in FIG. 10 and this pin engages a bulldozer 88 which is guided for reciprocating movement within a path way 89. Suitable materials such as toy logs may be manually placed in the area between the bulldozer 88 and the path way 78 and when the vehicle arrives to drive the rollers 38 the bulldozer will thereupon be actuated to shove the logs or other materials into the waiting vehicle and will then retreat to the upward part of its movement shown in FIG. 10. The operator then reverses the current to the vehicle causing its wheels to move the vehicle to the right as viewed in FIG. 10 whereupon it leaves rollers 38 and bulldozer 88 ceases to operate.

Figure 7:
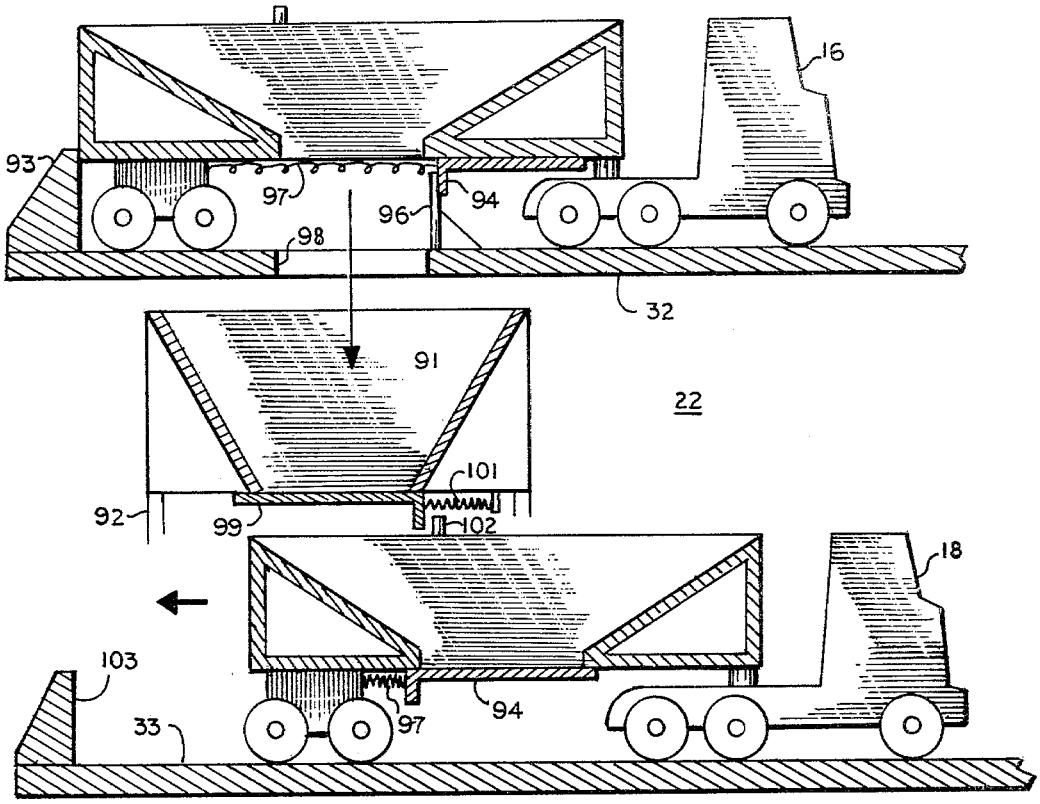
FIG. 7 is an elevation view of the intersecting spur tracks in the lower right hand corner of FIG. 1 with one of the tracks rotated 90° wherein a truck on an upper track or path drops material into a hopper and a truck on the lower level opens the hopper to cause the material to drop into the lower truck.

Illustrated in FIG. 7 is the accessory assembly 22 shown in the lower right hand part of FIG. 1. For purposes of illustration, one of the spur tracks 32 and 33 of FIG. 1 has been rotated 90° so that the tracks are in alignment. Whether the tracks are aligned or intersecting the operation of the mechanism is the same. The spur paths 32 and 33 are separated vertically by a sufficient distance so that a toy vehicle can be operated on the lower spur track 33 to place it underneath a vehicle on the upper spur track 32. Preferably this spacing is increased enough to include a hopper 91 suitably supported by posts 92. A vehicle 16 on the upper spur 32 moves to the left as viewed in FIG. 7 (downwardly as viewed in FIG. 1) until it strikes a stop 93. The vehicle 16 has a sliding bottom door 94 and as the vehicle 16 moves to the left as viewed in FIG. 7 a finger 96 disposed to one side of the track engages the sliding door 94 to open it as shown in the upper part of FIG. 7. A tension spring 97 normally keeps the sliding door closed. The upper track 32 has a hole 98 cut in it inside of the tread area for the path way 32 and as the vehicle 16 backs up toward its stop 93 the finger 96 opens the sliding door 94 and the material drops out of the bottom vehicle through the hole 98 and into the hopper 91.

The hopper 91 also has a similar sliding door 99 normally urged to the right as viewed in FIG. 7 by a tension spring 101. Disposed on the lower path way 33 is the vehicle 18 and it has an upwardly projecting lug 102 on its upper edge. As the vehicle 18 moves to the left in FIG. 7 this projecting lug 102 strikes the sliding door 99 to move it to the left until the vehicle 18 strikes a permanent stop 103 on the path way 33. As the sliding door 99 opens it drops the contents of the hopper into the vehicle 18 until all the contents of the hopper are empty.

Suitable switches (not shown) can interchange the trucks 16 and 18 on their respective halfs of the road way 15 so that the vehicle 18 can be run on the top track 32 and vehicle 16 on the bottom track 33 to again release the contents by gravity into the hopper or if desired directly into the lower vehicle.

In any event it is the backward movement of the vehicles on their path ways that operate the accessory to perform some simulated function of trucks or railroad cars in real life.

Referring now to all of the figures the accessory is the moveable object: the crane in FIGS. 4 and 6, the bulldozer in FIG. 10 and the sliding door in FIG. 7. The accessories are driven by the wheels of the vehicles in FIGS. 4, 6 and 10. The mechanism connecting the wheels and the accessory is the power take off means which includes the rollers, 38, shaft 39 gears 42, 43, and 44 and a mechanism drive which includes the connecting rod 47 of FIG. 3 and the oscillating arm 82 of FIG. 9. In the case of FIG. 7, such power takeoff means is unnecessary as it is the horizontal movement of the vehicles themselves that opens the hopper door 99. All of the accessories stop operation when the current to the vehicles is reversed and the vehicles move away from their stops in their normal forward motion.

We have described our invention with respect to presently preferred embodiments thereof as required by the statues. We do not limit ourselves to these embodiments as they are illustrative only and not limiting. Accordingly we include within the scope of the following claims all improvements, modifications, and variations, that fall within the true spirit and scope of our invention.

We claim:

1. In the combination of a reversible self-powered vehicle having at least one powered wheel, and an accessory powered by the vehicle, structure connecting the two comprising:

(a) a spur path upon which the vehicle rides;

(b) a permanent vehicle stop disposed along the spur for stopping movement of the vehicle;

(c) a mechanical power takeoff means located with respect to the spur and stop such that said powered wheel of the vehicle is in engagement with the power takeoff means while the vehicle is stopped;

(d) a mechanical drive connecting the power takeoff means and the accessory to energize the accessory;

(e) and manually operable remote means for reversing the direction of rotation of said powered wheel of the vehicle, to cause the vehicle to leave the stop whereby the powered wheel of the vehicle is removed from engagement with the power takeoff means and said accessory is de-energized.

2. The combination of claim 1 wherein the spur path includes a pair of rails upon which the vehicle rides.

3. The combination of claim 1 wherein the spur path is a roadway, and mechanical guide means control the vehicle on the path.

4. The combination of claim 1 wherein the power takeoff means includes a roller which is engaged by said powered wheel when the vehicle is stopped by said vehicle stop.

5. The combination of claim 1 wherein the accessory has a rotatable shaft and the mechanical drive is disposed between the rotatable shaft and the power take off means.

6. The combination of claim 1 wherein the accessory has an oscillating member and the mechanical drive includes a crank disc, an arm secured to the oscillating member and a connecting rod connecting the arm and the crank disc.

7. In the combination of a reversible self-powered vehicle having at least one powered wheel and an accessory powered by the vehicle, said accessory having an oscillating member, structure connecting the two comprising:

(a) a spur path upon which the vehicle rides;

(b) a permanent vehicle stop disposed along the spur for stopping movement of the vehicle;

(c) a mechanical power takeoff means located with respect to the spur and stop such that said powered wheel of the vehicle is in engagement with the power takeoff means while the vehicle is stopped;

(d) a mechanical drive connecting the power takeoff means and the accessory to energize the accessory, said mechanical drive including a crank disc, a crane arm secured to the oscillating member, and a connecting rod connecting the oscillating member and the crank disc;

(e) an electromagnet connected to the crane arm;

(f) a source of electric current for the accessory and connected to the electromagnet;

(g) a switch operable by said oscillating member and disposed between the current source and the electromagent for selectively connecting and disconnecting the source to the electromagnet so that ferrous material will be picked up by the magnet at one extreme of oscillation of said crane arm and released at the other extreme of oscillation of said crane arm;

(h) and manually operable remote means for reversing the direction of rotation of said powered wheel of the vehicle to cause the vehicle to leave the stop whereby the powered wheel of the vehicle is removed from engagement with the power takeoff means and said accessory is de-energized.

* * * * *